US006781924B2

(12) United States Patent
Gressly et al.

(10) Patent No.: US 6,781,924 B2
(45) Date of Patent: Aug. 24, 2004

(54) DEVICE FOR SECURING A DIAL IN A WATCHCASE

(75) Inventors: Chrystal Gressly, Delémont (CH); Laurent Kaelin, Sonvilier (CH); Jürg Schneiter, Utzenstorf (CH)

(73) Assignee: Eta SA Fabriques d/Ebauches, Grenchen (CH)

( * ) Notice: Subject to any disclaimer, the term of this patent is extended or adjusted under 35 U.S.C. 154(b) by 159 days.

(21) Appl. No.: 10/191,400

(22) Filed: Jul. 10, 2002

(65) Prior Publication Data

US 2003/0012086 A1 Jan. 16, 2003

(30) Foreign Application Priority Data

Jul. 12, 2001 (CH) ..... 1285/01

(51) Int. Cl.[7] ..... G04B 19/06; G04B 19/14
(52) U.S. Cl. ..... 368/236; 368/314
(58) Field of Search ..... 368/228, 232, 368/236, 237, 314

(56) References Cited

U.S. PATENT DOCUMENTS 4,150,538 A 4/1979 Nakayama et al.
5,265,071 A * 11/1993 Thorgersen et al. ..... 368/67
5,430,694 A * 7/1995 Perrot ..... 368/88
5,699,324 A * 12/1997 Perrot et al. ..... 368/226

FOREIGN PATENT DOCUMENTS

CH 333986 A 11/1958
JP 60181676 9/1985

* cited by examiner

*Primary Examiner*—Vit W. Miska
(74) *Attorney, Agent, or Firm*—Griffin & Szipl, P.C.

(57) ABSTRACT

The dial (3) is secured onto a lower element (10) of the case, preferably the casing ring. The lower element (10) includes at least two through passages (12) each having a first part (13) forming an orifice (14) on the dial (3) side separated from a second part (17) on the opposite side, by a neck portion (15), the whole of the first part and at least a portion of the second part of said passages (12) being filled with an adhesive material (19) having a strong power of adhesion to at least the material forming the lower face of the dial (3).

13 Claims, 1 Drawing Sheet

DEVICE FOR SECURING A DIAL IN A WATCHCASE

FIELD OF THE INVENTION

The present invention concerns a device for securing a dial in a watchcase, or any other timepiece to enable the watch movement and the dial to be pre-assembled before mounting the other exterior watch parts. The invention concerns more particularly a device of this type in which the dial is secured to the casing ring.

BACKGROUND OF THE INVENTION

A large number of devices have already been proposed for immobilising a dial on, or between, the constituent elements of a watchcase. Many devices concern clamping the dial between one or more lower elements, such as a plate, a casing ring or a middle part, and one, or more upper elements, such as a flange, a crystal or a bezel. These types of devices are well suited to manual assembly, but are less satisfactory for automatic or semi-automatic assembly, where pre-assembly of the movement, dial and display device is desirable before the exterior watch elements are assembled.

Several solutions have been proposed to achieve the above object. It is for example possible to screw the dial at two or three points on the bottom of the plate or on the casing ring. Japanese Patent Application No. 1467/96 proposes a bolt connection at the centre with a passage for the hand pipes. U.S. Pat. No. 4,320,483 discloses a magnetic coupling device between the dial and the plate.

Among the other solutions which have given rise to numerous variants, the principle consisting in providing feet secured to the lower surface of the dial should be cited, said feet being immobilised in a lower element of the case by welding, screwing or locking. As regards locking, European Patent No. 0 465 988 may be cited wherein each foot of the dial is locked into the plate by a post riveted in proximity thereto.

According to a simpler solution, disclosed in Swiss Patent No. 485 259, the dial feet are bonded inside housings arranged in the casing ring. One could even envisage an even simpler embodiment wherein the dial has no feet and wherein the bonding is done directly on the upper surface of the casing ring. All cases necessitate a product that can bond both the material of the dial and that of the casing ring, or of any other lower connecting element. This is most often the case, but it sometimes happens that it is impossible to find such a product in particular when the casing ring is a synthetic material for which no adhesive with sufficient adhesion currently exists.

The object of the present invention is thus to provide a simple and economic assembly of a dial with a lower element of a watchcase, in particular a casing ring, using an adhesive material.

SUMMARY OF THE INVENTION

The invention therefore concerns a device for securing a dial onto a lower element of a case intended to accommodate a watch movement, or onto a lower element contained therein. The device is characterised in that the lower element includes at least two through passages each having a first part on the dial side separated from a second part on the opposite side by a neck portion, the whole of their first part and at least a portion of the second part of said passages being filled with an adhesive material having a strong power of adhesion to at least the material forming the lower face of the dial.

As will be seen in the following detailed description, the neck portion may be obtained in different ways. In a preferred embodiment, the first and second parts of the through passages form paths with their generators perpendicular to the general plane of the case, i.e. to the dial itself. These paths evidently have a contour fitted to the space available for arranging the through passages through the lower element.

According to another embodiment, the axes of the first and second parts of the through passages form a broken line.

In order to facilitate pre-assembly of the dial to the movement, the lower element is preferably the casing ring or radial extensions of the bottom of the plate of the watch movement. The device according to the invention is particularly advantageous when the dial is secured onto casing ring. Indeed, one of the materials most commonly used to make casing rings is a polyoxymethylene, marketed by Duport under the trademark Delrin® because of its very low friction coefficient, which facilitates the assembly operations. Unfortunately, this material is excessively difficult, not to say impossible, to bond. The device according to the invention thus enables its tribological qualities to be used to advantage while allowing bonding with a dial, which does not require any particular conformation, such as feet to secure it.

BRIEF DESCRIPTION OF THE DRAWINGS

Other features and advantages of the present invention will appear more clearly upon reading the following detailed description of an example embodiment given by way of non-limiting illustration with reference to the annexed drawings, in which.

DETAILED DESCRIPTION OF THE PREFERRED EMBODIMENTS

Figure 1:
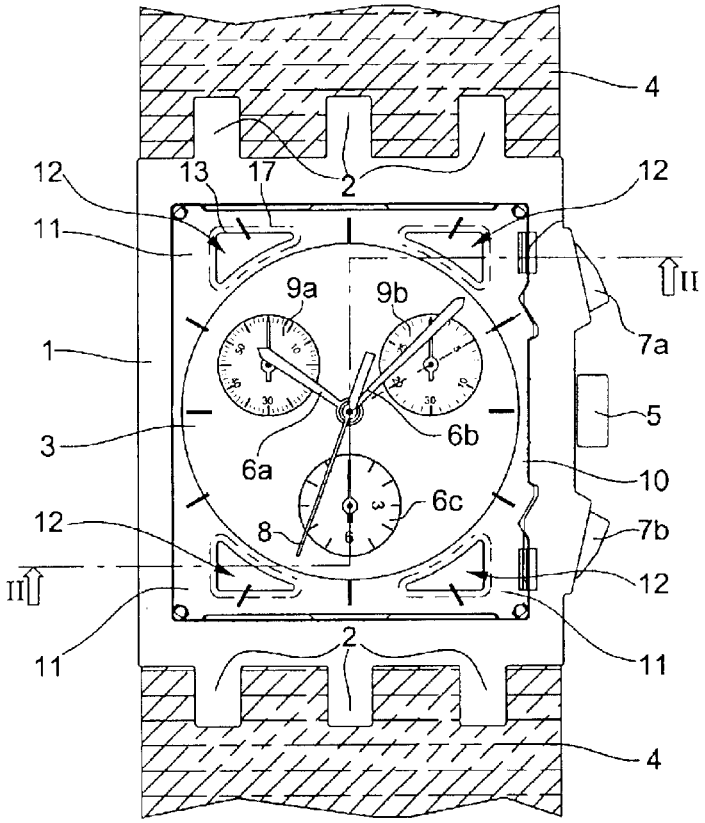
FIG. 1 shows a top view of a chronograph watch with a rectangular dial.

FIG. 1 shows a chronograph watch whose case has a rectangular middle part 1 in which the upper closing elements (crystal, bezel or extension of the middle part) are not shown. Middle part 1 is provided with horns 2 allowing a wristband 4 to be secured thereto. For ease of comprehension, it has also been assumed that rectangular dial 3 is transparent.

The chronograph watch includes, in a conventional manner, a crown 5, for example for setting to the correct time an analogue display by means of hour-minute hands 6*a* and 6*b* and small seconds hand 6*c* on a dial at 6 o'clock. The chronograph function is controlled by two push buttons 7*a*, 7*b*, the display of the measured times being achieved by means of a centre second hand 8, a minute counter 9*a* and a tenth of a second counter 9*b*. The movement which drives the time display and the chronograph function will not be described as it does not form part of the invention and could be any movement known to those skilled in the art. In most cases, the movement is a round calibre housed in a casing ring 10. The term "casing ring" is used by extension given that the outer contour is of rectangular shape to match the inner contour of middle part 1. This construction thus leaves four dead zones 11 which will be used to secure the dial as explained hereinafter also with reference to FIG. 2.

The left part of this cross-section is shown prior to securing dial 3 and the right part after bonding by means of an adhesive material 19 also forming a plug. As can be seen, each through passage 12 includes two parts. A first part 13 forming an orifice 14 on the side of dial 3; a second part 17 is connected to the first and forms a neck portion 15.

Figure 2:
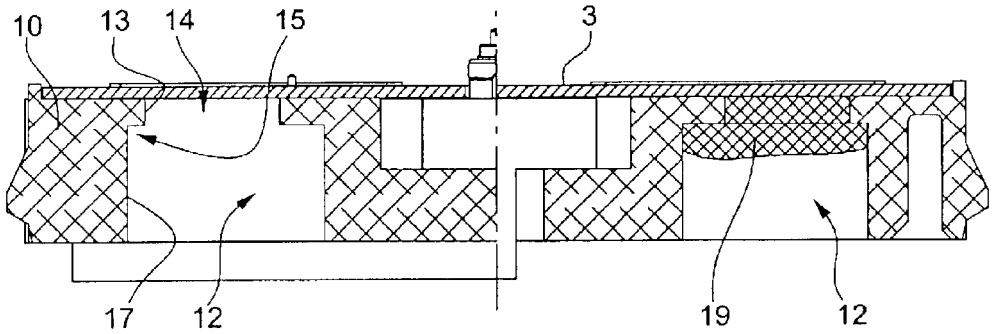
FIG. 2 shows in half cross-sections through the 12 o'clock-6 o'clock line, along the arrows II—II of FIG. 1, the assembly of the dial and the casing ring.

In the embodiment shown in FIG. 2, the generators of the inner surfaces of each part are perpendicular to dial 3 and orifice 14 has a smaller section than the section of the second part such that neck portion 15 is in fact formed by an edge between first part 13 and second part 15.

Figure 3:
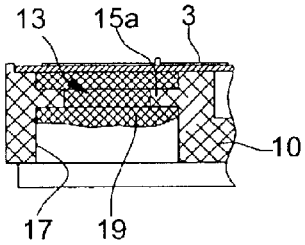
FIGS. 3 to 6 show variants of the through passages visible in FIG. 2.

FIG. 3 shows a variant wherein the first and second parts 13, 17 are exactly in line with each other, the neck portion being formed by a rib 15*a* separating the two parts.

Figure 4:
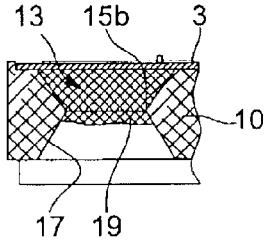

FIG. 4 shows another variant wherein the generators of the first and second parts 13, 17 are oblique and move away from the direction perpendicular to dial 3 from an edge 15*b* forming the neck portion.

Figure 5:
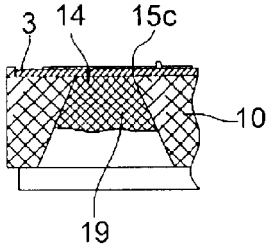

The generators of first part 13 could of course be perpendicular to the plane of dial 3, or even be in line with the generators of second part 17, as shown in FIG. 5, the neck portion then being formed by edge 15*c* of orifice 14.

Figure 6:
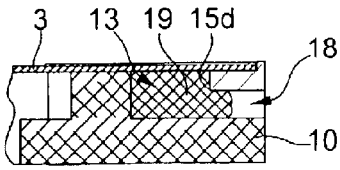

According to a slightly different variant shown in FIG. 6, it can be seen that the axes of first parts 13 and second parts 18 of through passages 12 are not parallel but instead form a broken line, so that the neck portion is formed by the inflection point between the two axes. In the example shown, these two axes are perpendicular and the second part of the through passage has an orifice which opens out onto one side of the casing ring. In this embodiment, it is clear that the material filling the passage forms a "plug", as soon as it fills a portion of the second part of the through passage, whatever the respective sections of the first and second parts.

With the configurations which have just been described, a perfectly flat dial 3, including only holes for the passage of the arbours for the hands, may be secured by bonding by inserting a material 19 with a strong power of adhesion to at least the inner surface of dial 3, into through passages 12. The quantity of adhesive material 19 inserted has to be such that it fills all of first part 13 of through passage 12 and overflows beyond neck portion 15 into second part 17. Adhesive material 19 is chosen so that it is liquid when applied, and solid at ambient temperature to form, in a way, a plug which is impossible to remove, even if said material 19 has low or zero power of adhesion to the walls of through passage 12, as is the case when casing ring 10 is made of Delrin®. Adhesive material 19 is for example selected from the range of holt-melt materials including in particular polyamides, polyesters and polyurethane's. Thermosetting materials or epoxy type adhesives may also be used.

With a rectangular dial through passages 12 have a substantially triangular shaped section. For an oval-shaped dial the section will be bean-shaped. If a round dial is used the section of orifice 14 will have to smaller, but it is possible to increase the number of through passages 12; it may then be advantageous to connect all the lower parts by an annular feed.

Instead of securing dial 3 onto casing ring 10, it can be secured, in accordance with the same method that has just been described, onto another lower element such as the bottom of the movement plate or an extension thereof. The only difference will lie in the depth of through passages 12. The method according to the invention may have an advantage even if one knows materials capable of adhering to a metal, for example that used for the bottom of the plate. It is in fact well known that the force of adhesion to a metal depends on the precautions taken as to the surface-finish, and that it may be necessary to use an adhesive primer, expensive operations for the final product, without however guaranteeing the durability of adhesion which, for a metal, depends very much on the ambient conditions and especially humidity levels.

Those skilled in the art may also envisage other variants without departing from the scope of the present invention.

What is claimed is:

1. A device for securing a dial onto a lower element of a case intended to accommodate a watch movement, or onto a lower element contained therein, wherein the lower element includes at least two through passages each having a first part forming an orifice on the dial side separated from a second part by a neck portion, the whole of the first part and at least a portion of the second part of said passages being filled with an adhesive material having a strong power of adhesion to at least the material forming the lower face of the dial.

2. A securing device according to claim 1, wherein the orifices of the through passages are located on the top face on the dial side and on the opposite bottom face of the lower element.

3. A securing device according to claim 2, wherein the inner surfaces of the first and second parts of the through passages have generators perpendicular to the dial delimiting, on the dial side, an orifice of smaller section than the section of the orifice on the opposite side, the neck portion being formed by a shoulder created between the first and second parts.

4. A securing device according to claim 2, wherein at the junction between the two parts of the through passages the section of the first part is less than the section of an immediately lower zone in the second part of each through passage, whatever the orientation of the generators of the first and second parts with respect to a direction perpendicular to the dial.

5. A securing device according to claim 2, wherein the neck portion is merged with the edge of the orifice on the dial side.

6. A securing device according to claim 1, wherein the axes of the first parts and second parts form a broken line.

7. A securing device according to claim 1, wherein the lower element including the through passages is a casing ring.

8. A securing device according to claim 1, wherein the lower element including the through passages is formed by a plate bottom or by extensions thereof extending radially beyond the movement.

9. A securing device according to claim 1, wherein the adhesive material is selected from among thermomelt or thermosetting compounds, and adhesive materials, for example of the epoxy type.

10. A securing device according to claim 1, wherein the adhesive material has a low or zero power of adhesion to the material forming the lower element.

11. A device for securing a dial in a shaped case, intended to accommodate a circular watch movement held in place by a casing ring whose outer contour matches the inner contour of the case, wherein the casing ring includes four through passages each having a first part on the dial side of smaller section than the section of the second part on the opposite side, the whole of the first part and at least a portion of the second part of said through passages being filled with an adhesive material having a strong power of adhesion to the material forming the lower face of the dial.

12. A securing device according to claim 11, wherein the case is rectangular and in that the through passages are located in dead zones substantially at the 1 o'clock, 5 o'clock, 7 o'clock and 11 o'clock positions.

13. A securing device according to claim 11, wherein the adhesive material has a low or zero power of adhesion to the material forming the casing ring.

* * * * *